US011624572B2

(12) United States Patent
Volk et al.

(10) Patent No.: US 11,624,572 B2
(45) Date of Patent: Apr. 11, 2023

(54) PUMP-ACTION FIREARM

(71) Applicant: Ballistic Arts Group, LLC, Pisgah Forest, NC (US)

(72) Inventors: Oleg Volk, Lebanon, TN (US); Ryan D. Croft, Pisgah Forest, NC (US)

(73) Assignee: Ballistic Arts Group, LLC, Pisgah Forest, NC (US)

( * ) Notice: Subject to any disclaimer, the term of this patent is extended or adjusted under 35 U.S.C. 154(b) by 0 days.

(21) Appl. No.: 17/564,659

(22) Filed: Dec. 29, 2021

(65) Prior Publication Data

US 2022/0276014 A1 Sep. 1, 2022

Related U.S. Application Data

(60) Provisional application No. 63/131,501, filed on Dec. 29, 2020.

(51) Int. Cl.
*F41A 9/26* (2006.01)
*F41C 7/02* (2006.01)

(52) U.S. Cl.
CPC ..... *F41A 9/26* (2013.01); *F41C 7/025* (2013.01)

(58) Field of Classification Search
CPC ..... F41A 9/26; F41A 9/27; F41A 9/28; F41C 7/02; F41C 7/025
USPC ..... 42/19
See application file for complete search history.

(56) References Cited

U.S. PATENT DOCUMENTS

| | | | | | |
|---|---|---|---|---|---|
| 1,844,779 | A * | 2/1932 | Messenie | F41C 7/02 | 42/59 |
| 3,892,082 | A * | 7/1975 | Dornhan | F41A 3/38 | 89/161 |
| 4,619,063 | A * | 10/1986 | Hill | F41A 9/68 | 42/19 |
| 4,709,617 | A * | 12/1987 | Anderson | F41A 5/16 | 89/157 |
| 7,194,834 | B2 * | 3/2007 | Falenwolfe | F41A 9/38 | 42/65 |
| 10,180,295 | B1 * | 1/2019 | Tang | F41A 9/27 | |
| 2002/0078614 | A1 * | 6/2002 | Kornberger | F41A 9/28 | 42/59 |
| 2011/0186027 | A1 * | 8/2011 | Casas Salva | F41A 17/82 | 124/74 |
| 2012/0144712 | A1 | 6/2012 | Rostocil | | |
| 2017/0067715 | A1 * | 3/2017 | Conant | F41A 3/66 | |

* cited by examiner

*Primary Examiner* — Bret Hayes
(74) *Attorney, Agent, or Firm* — Wood Herron & Evans LLP

(57) ABSTRACT

Provided is a pump-action firearm having a frame. A barrel having a chamber is supported on the frame. A rotating ammunition clip has a plurality of circumferentially spaced cartridge sockets and is removably supported by the frame. A bolt is manually slidably cycled between in-battery and retracted positions. The bolt is moveable into a socket to push a cartridge out of the socket and into the chamber to the in-battery position and retractable to extract the cartridge from the chamber and back into the socket.

5 Claims, 19 Drawing Sheets

30
26
58
28
16
108
124
12
20
14
130
74
18
60
24
22

PUMP-ACTION FIREARM

RELATED APPLICATIONS

This application claims priority to U.S. Provisional Patent Application No. 63/131,501, filed Dec. 29, 2020, and incorporates the same herein by reference.

TECHNICAL FIELD

This invention relates to a pump-action firearm. More particularly, it relates to such a firearm that uses a removable, rotating ammunition feeding clip which retains, rather than ejects, spent cartridge casings.

BACKGROUND

Various designs for a carbine rifle in a pistol caliber have been made with the intention of making a firearm that is both exceptionally reliable and low cost to manufacture. For various reasons, it may also be desirable to have a firearm that does not eject empty cartridge casings, but that has a higher ammunition capacity and is easier to reload than a traditional revolver. Traditional semi-automatic or pump-action rifles or shotguns that use a detachable magazine eject spent cartridge casings when the action is cycled.

SUMMARY OF THE INVENTION

Provided is a pump-action firearm having a frame. A barrel having a chamber is supported on the frame. A rotating ammunition clip has a plurality of circumferentially spaced cartridge sockets and is removably supported by the frame. A bolt is manually slidably cycled between in-battery and retracted positions. The bolt is moveable into a socket to push a cartridge out of the socket and into the chamber to the in-battery position and retractable to extract the cartridge from the chamber and back into the socket.

The firearm may be a carbine rifle, pistol caliber rifle, or a shotgun in a bullpup configuration. The pump-action cycling uses a removable and replaceable en bloc rotary ammunition clip (technically, not a magazine) that retains spent cartridge casings. The design is built on a simple frame that may be covered with removable side slab panels made from a lightweight plastic material. A spent cartridge is extracted, the hammer re-cocked, and a new cartridge fed into the chamber by a sliding bolt mechanism that is locked into place by vertical movement of one or more lock members, similar in some ways to that of a falling-block action.

A rotating en bloc clip is used as an ammunition feeding mechanism. This rotating cylinder clip (or "drumlette") is not a true "magazine," because it does not include a spring to self-advance a next round of ammunition and it retains empty cartridge casings after being fired. The rotating clip houses a series of circumferentially positioned cartridges in individual sockets. Radially arranged ratchet teeth or pawls on a rear face of the clip body are used to rotate it each time the action is manually cycled. There is no winding required, as is the case in a drum magazine, because it is not internally spring-driven.

The action moves linearly, as does each cartridge as it is chambered and extracted. This allows the use of any bullet shape in the cartridge, including full wadcutters (cylindrical projectile) to maximize bullet weight in subsonic loadings. The cartridge is fully and symmetrically supported in the chamber, as there is no ramp or ramp cut. As a result, we expect measurable performance increases over asymmetric and/or fractionally supported chamber designs, and an increase in safety related metrics. Likewise, any reliability issues that may occur in an action where cartridges are stripped from a magazine and fed into the chamber at an angle are also eliminated.

The orientation of the ammunition loaded in the end-block has a secondary effect of increasing the durability of the net assembly. This is due, at least in part, to the metal sides of the cartridges protruding several thousands of an inch outside the diameter of the end-block body. The bullpup (trigger forward of the chamber) configuration improves balance, providing easier handling (stable and "pointable"), and expands the lifetime ergonomic potential of the design. The design is engineered for "blast forward" safety in the event of a catastrophic failure.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawings, wherein.

DETAILED DESCRIPTION

Figure 1:
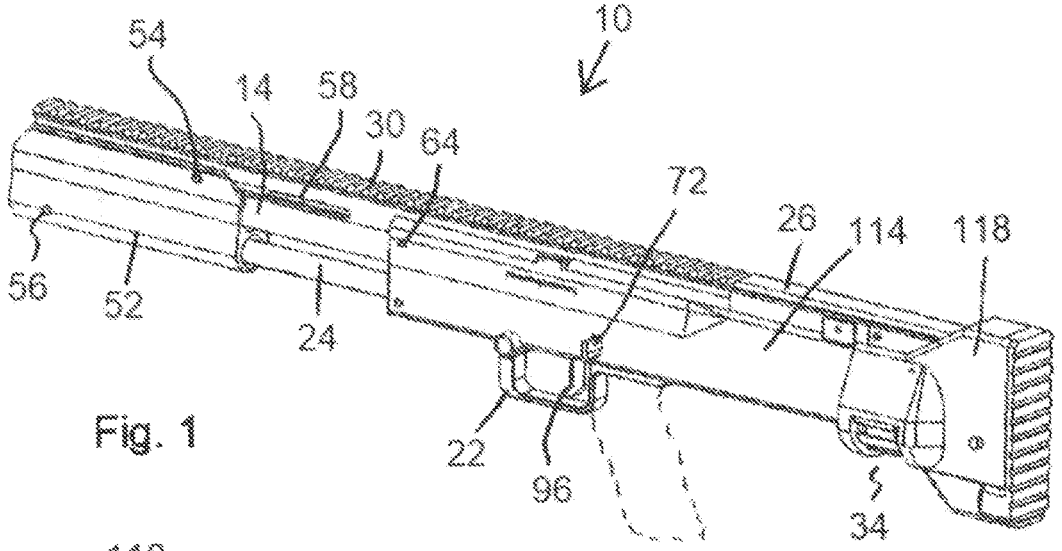
FIG. 1 is a first rear isometric view showing the left side of a carbine rifle according to one embodiment of the present invention.
Figure 2:
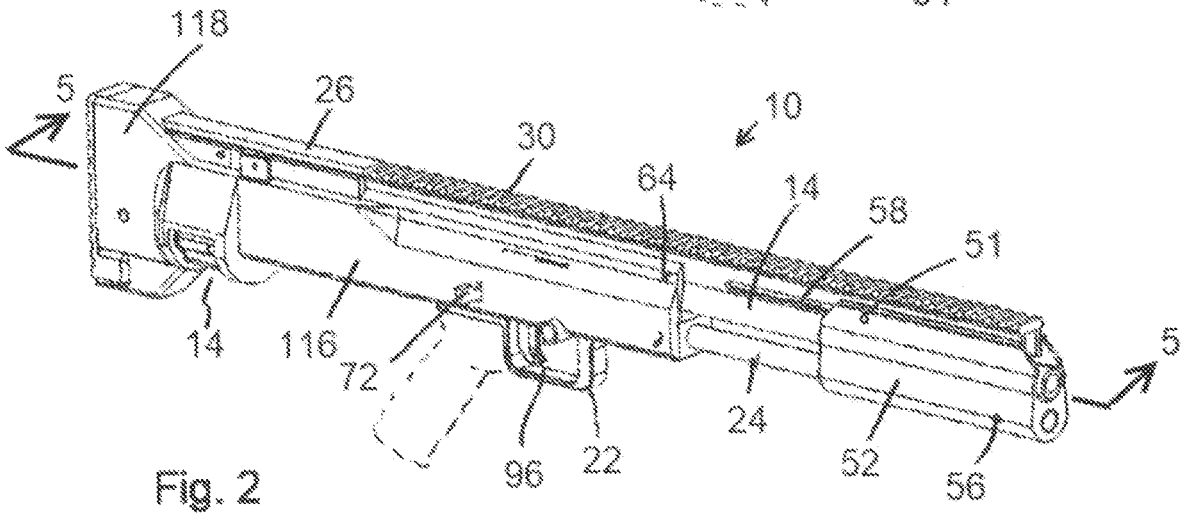
FIG. 2 is a second isometric view showing the right side thereof.
Figure 3:
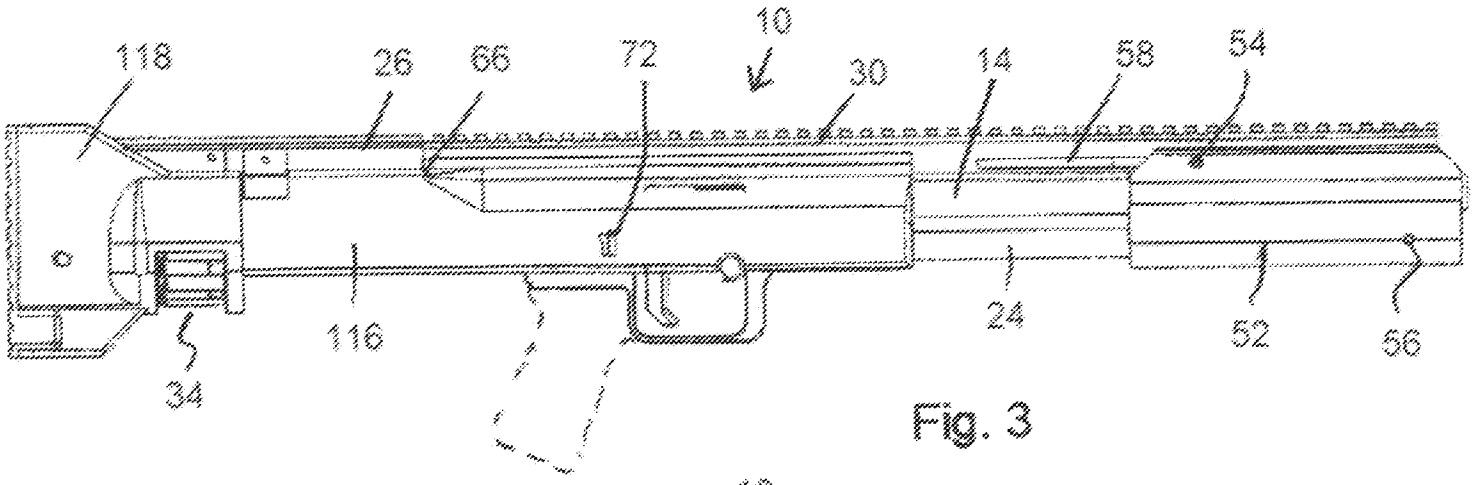
FIG. 3 is a right side elevational view thereof.
Figure 4:
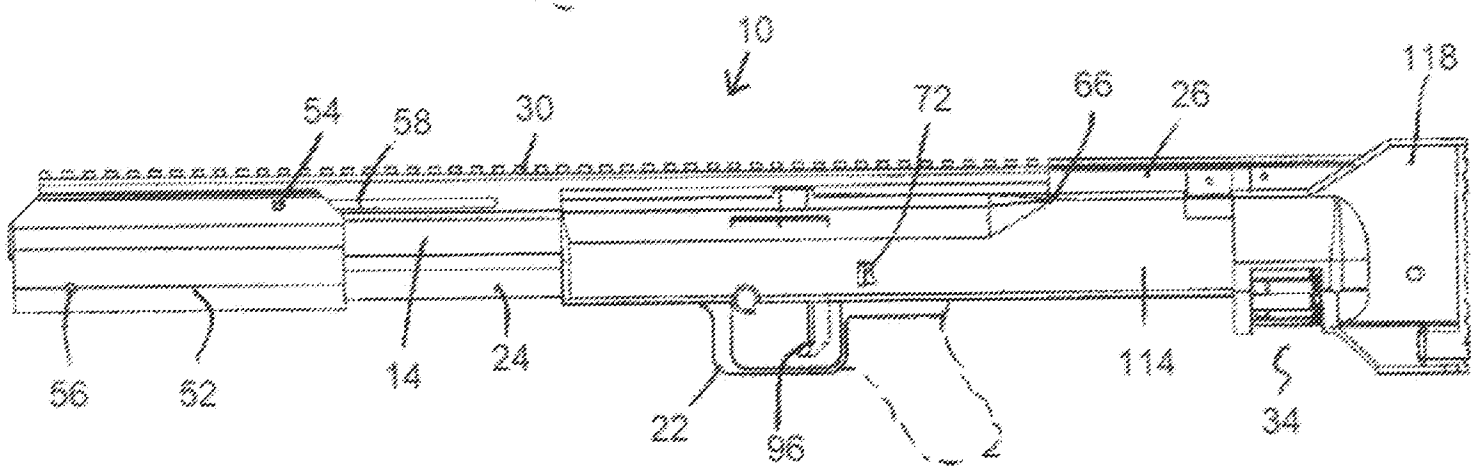
FIG. 4 is a left side elevational view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

"Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIGS. 1-4, therein is shown at 10 a carbine rifle according to one embodiment of the present invention. In general, this embodiment provides a rifle in a "bullpup" configuration, in which the ammunition is fed into a firing chamber and has a fire control group all located rearward of the grip and trigger. This embodiment is cycled manually as a pump-action that loads ammunition cartridges from circumferentially situated sockets in a rotating clip and replaces spent cartridge casings into the same sockets.

Figure 5A:
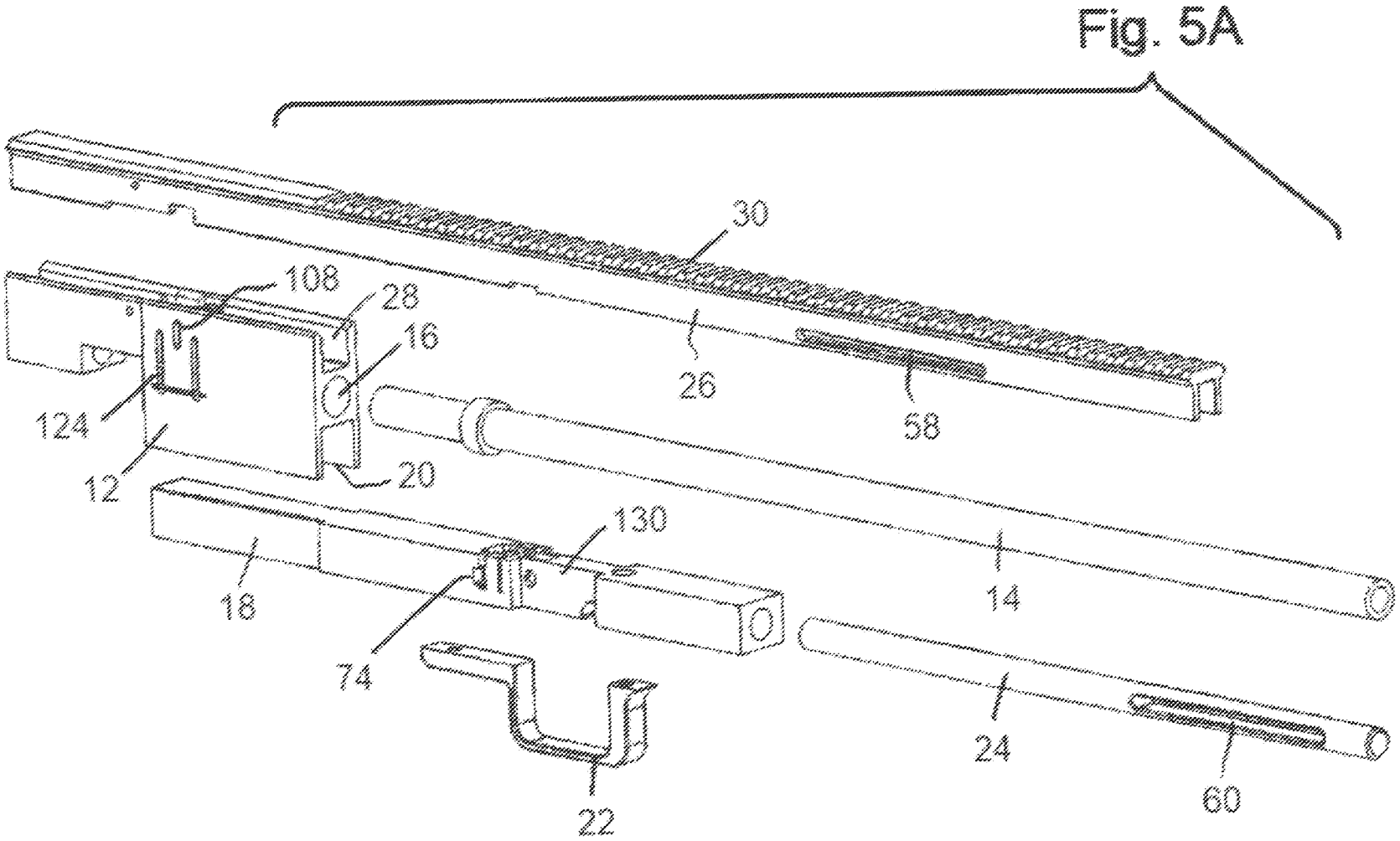
FIG. 5A is an exploded isometric view of certain supporting structures in one embodiment of the rifle, with the barrel.
Figure 5B:
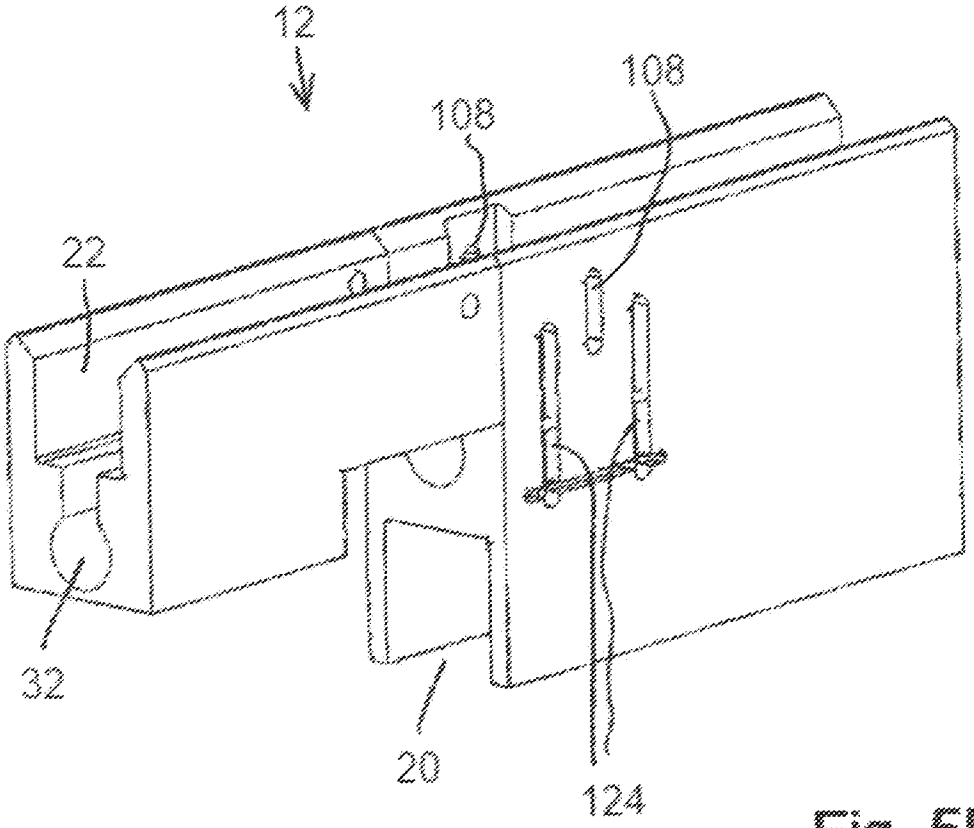
FIG. 5B is an isometric view of a frame or receiver of the rifle.

Referring now to FIG. 5A, therein is shown an exploded isometric view of selected structural components of the carbine rifle. There is a frame or receiver 12 to which a barrel 14 may be attached, such as by insertion into a barrel socket 16. Attachment may be by any of several known means, such as a threaded engagement or clamping. Another supporting structural member is a grip rail 18 that can be received into a lower channel 20 of the receiver 12. The grip rail 18 supports a trigger guard 22, other trigger components (not shown), and a forwardly extending pump grip guide 24. A top rail 26, which engages with an upper channel 28 in the receiver 12, may include a Picatinny (1913 MIL-STD) accessory attachment rail 30 along at least a portion of its upper surface. Referring also to FIG. 5B, the receiver 12 includes a longitudinal bolt channel 32 and various other sockets and slots that will be identified and explained in more detail below with respect to other features of the invention.

As shown in the right side sectional view of FIG. 5C, the assembled combination of the receiver 12, grip rail 18, pump grip guide 24, and top rail 26 support and guide all of the moving components of the fire control group of parts and cycling the action, each of which will be described in more detail below.

Figure 6:
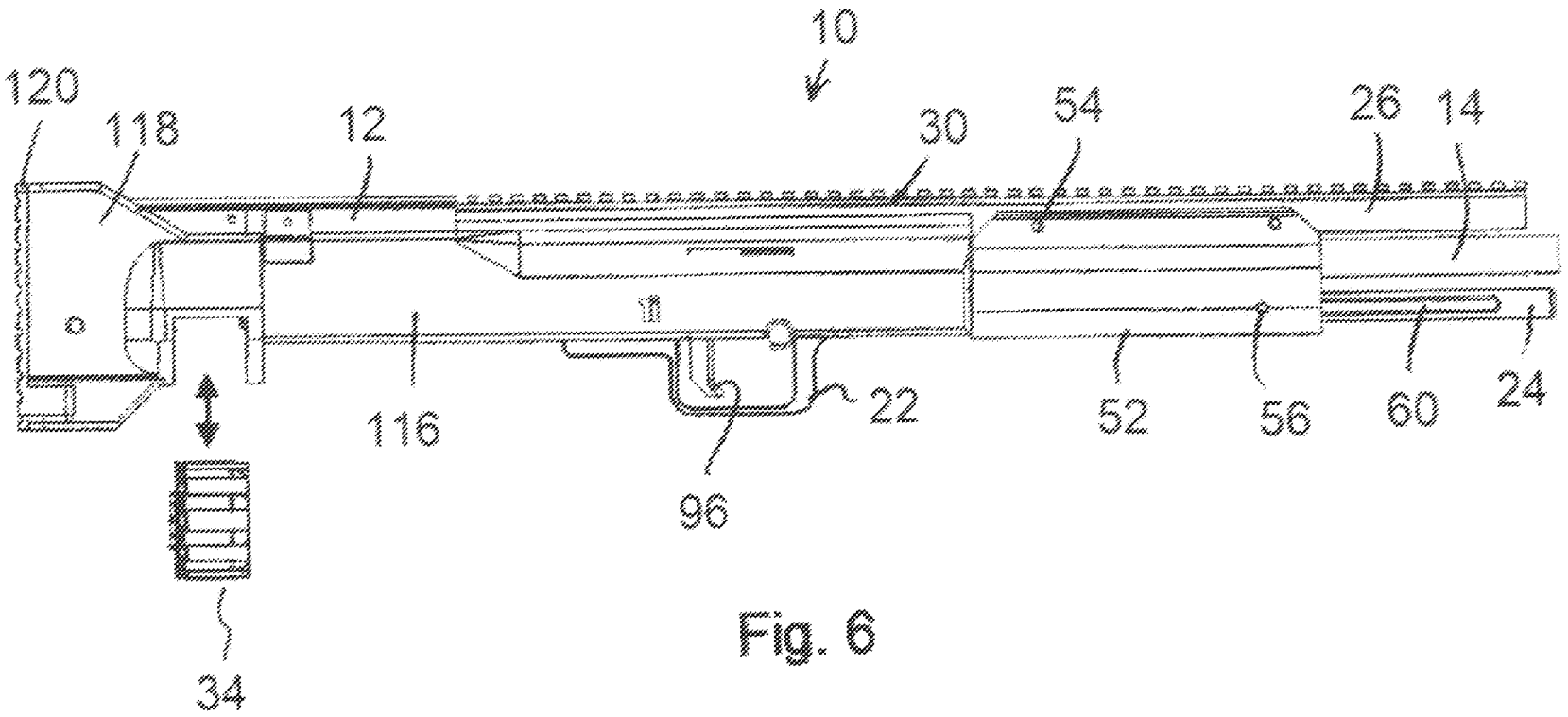
FIG. 6 is a side elevation view showing the ammunition clip detached and the pump grip and action in a fully retracted or open position.
Figure 8:
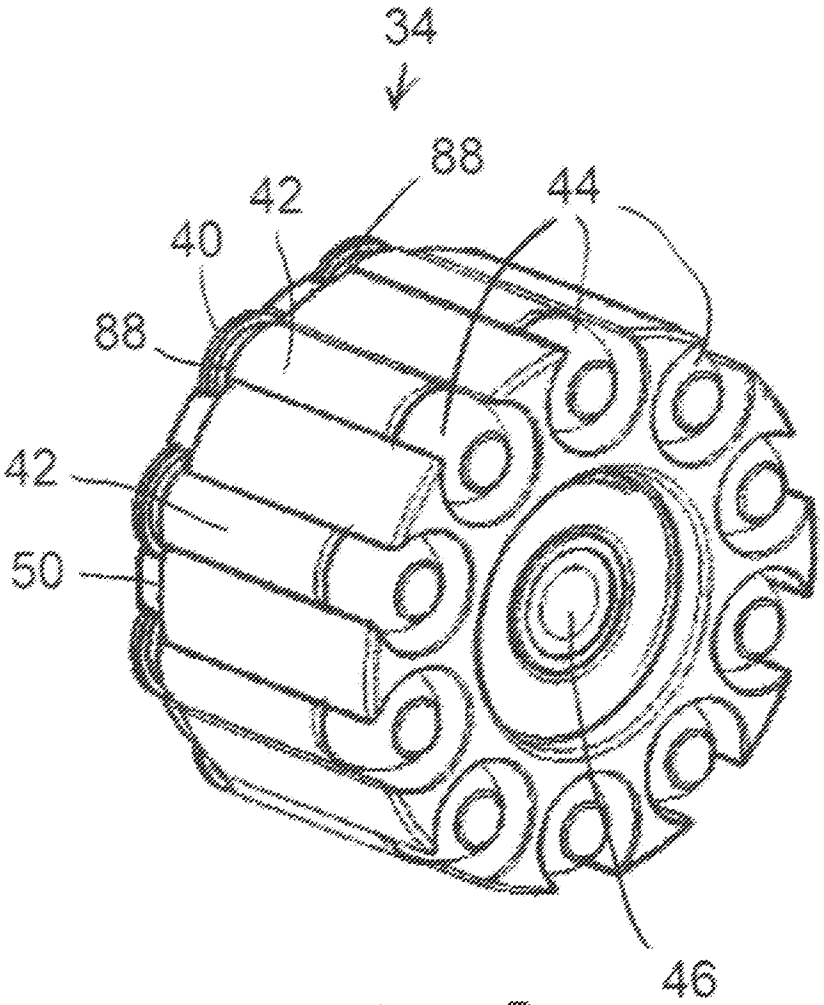
FIG. 8 is a forward isometric view thereof.
Figure 7:
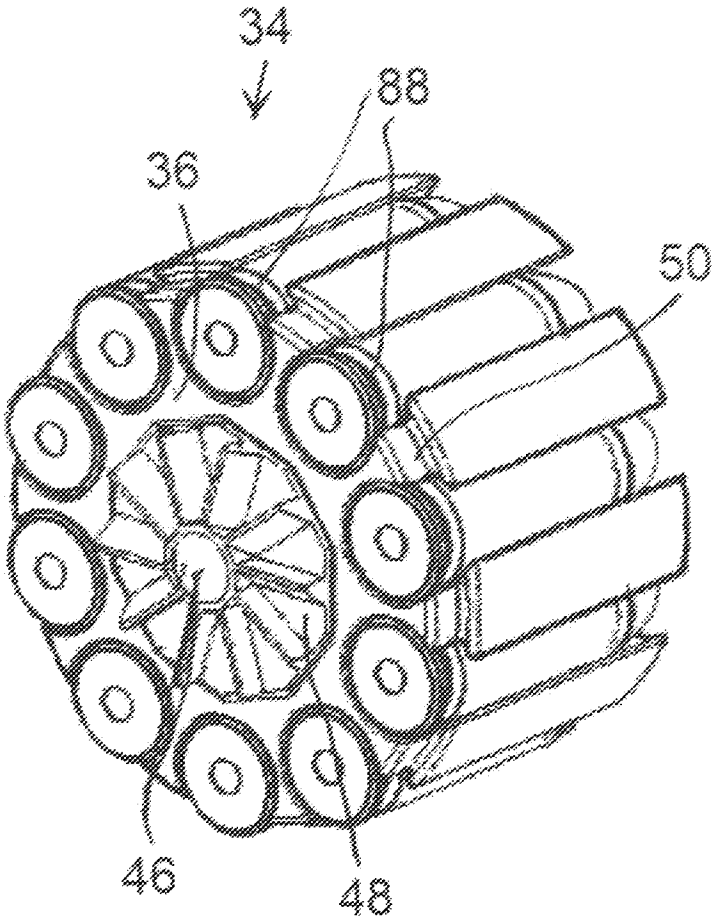
FIG. 7 is a rear isometric view of a loaded rotary ammunition clip according to one embodiment of the present invention.

Referring now to FIGS. 6-8, therein is shown a rotary ammunition clip assembly 34 detached from the rifle 10. The clip assembly 34 includes a main body 36 having a series of longitudinally oriented cartridge sockets 38 circumferentially positioned around the periphery of the main body 36 in a parallel axis orientation. Each socket 38 receives a separate ammunition cartridge 40. The cartridge 40 illustrated includes a metallic casing 42 and projectile 44, such as a 10 mm pistol round. Alternatively, the present invention may be adapted for other calibers, rimmed cartridges, or shotgun shells. The main body 36 has an axially centered opening 46 which is used to orient and hold the clip assembly 34 in place in the rifle 10, and which provides a rotation axis. Each of the cartridge sockets 38 is less than a complete tube, having a peripheral slot positioned radially outward to allow a bolt assembly to pass through the sockets 38, as will be described separately below. A rear face of the main body 36 also includes a series of radially oriented ratchet pawls or teeth 48, which are used for indexing and rotationally advancing the clip assembly 34 when the action is cycled. An annular groove 50 is provided around the rear periphery of the main body 36 to allow passage of an extractor (not shown) from one cartridge 40 to another as the clip assembly 34 is rotated.

Figure 5C:
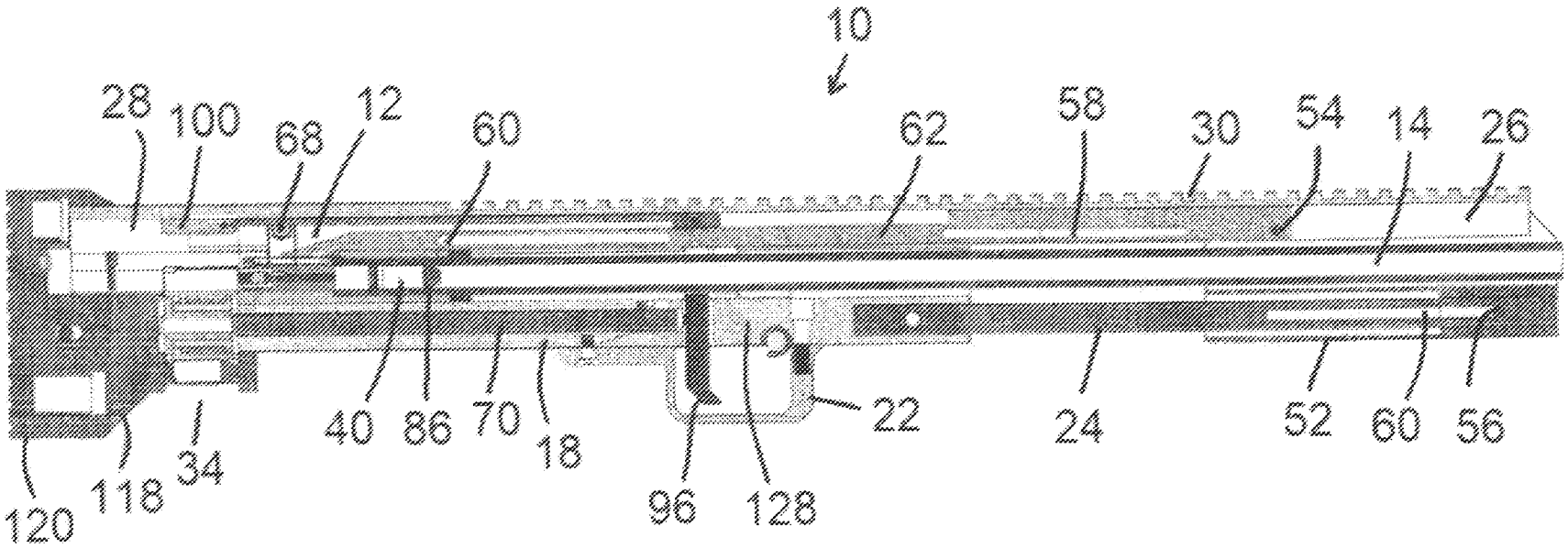
FIG. 5C is a side sectional view taken substantially along line 5-5 of FIG. 2.

Referring now to FIG. 5C, a forward pump grip 52 is carried by upper and lower cross pins 54, 56 that are guided by a first guide channel 58 in the top rail 26 and a second guide channel 60 in the pump grip guide 24. The upper cross pin 54 secures the pump grip 52 to an operating rod 62, which is guided by third and fourth cross pins 64, 66 carried by the top rail 26. Longitudinal movement of the pump grip 52 results in corresponding longitudinal movement of the operating rod 62. The operating rod 62 engages a bolt 68, which is carried in the bolt channel 32 of the receiver 12 in an aft portion of the rifle 10. The pump grip 52, operating rod 62, and bolt 68 are shown in the forwardmost, in-battery position in FIG. 5C. Referring now also to FIG. 6, the pump grip 52, operating rod 62, and bolt 68 are shown cycled to the rear position, which allows insertion and removal of the clip ammunition clip assembly 34. If desired, the pump grip 52 may be at least partially spring biased toward the forward, in-battery position by a compression spring (not shown) situated around the pump grip guide 24, forward of the grip rail 18.

Figure 9:
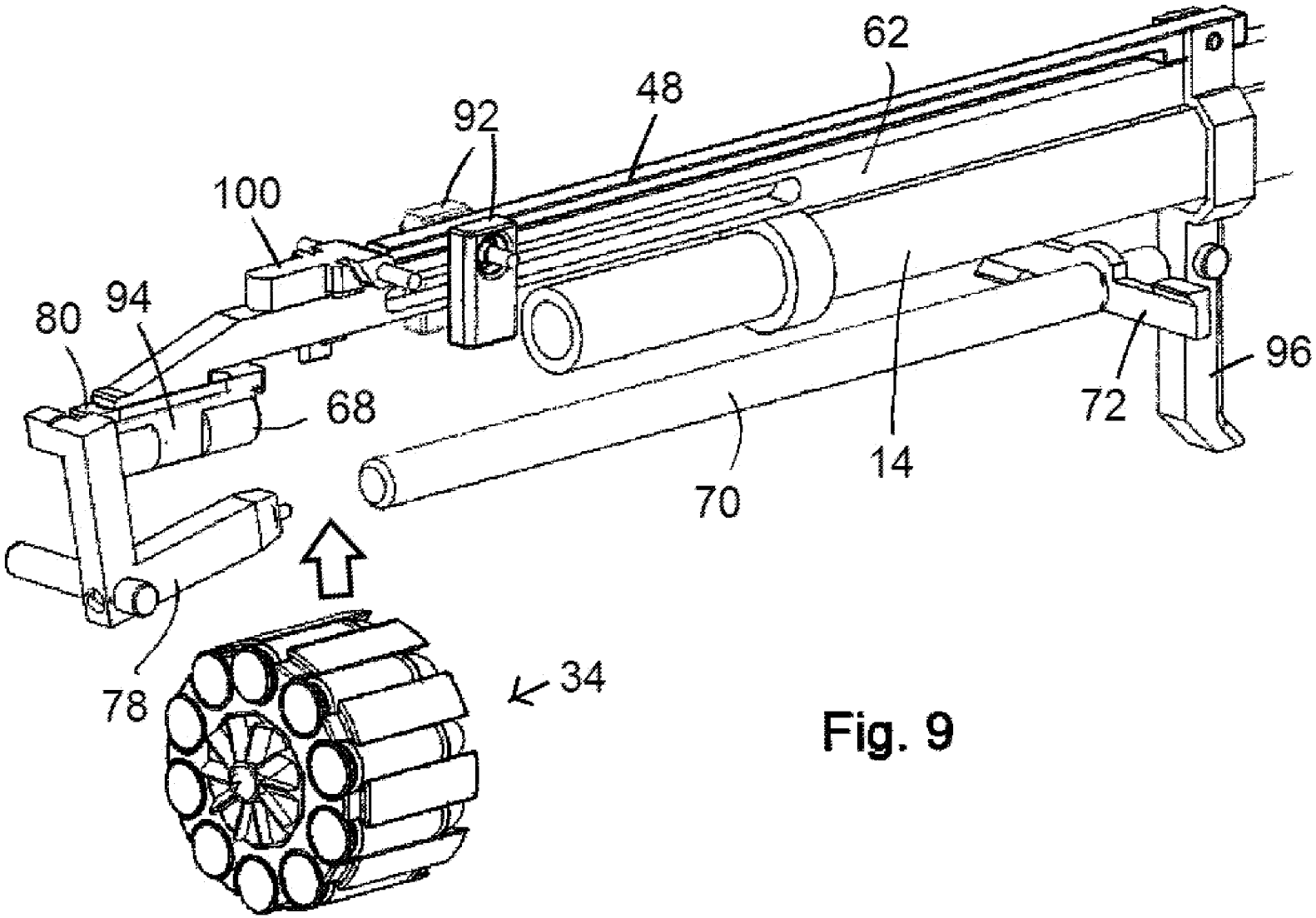
FIG. 9 is an isometric partial view of the action mechanism in a fully opened position of a carbine rifle according to one embodiment of the present invention in which, for clarity, the frame and outer housing parts have been removed and the rotary ammunition clip is detached.
Figure 10:
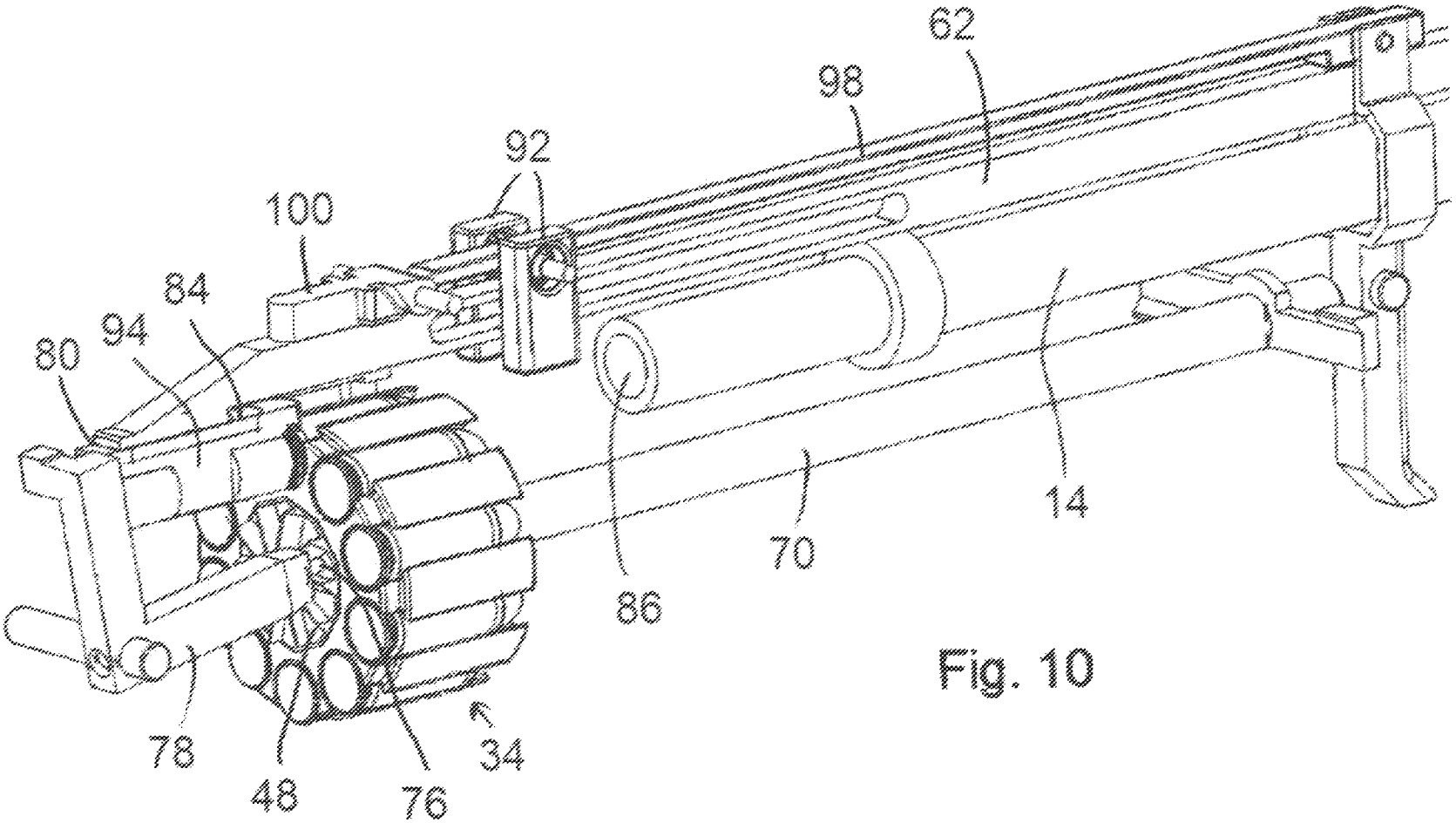
FIG. 10 is an isometric partial view similar to FIG. 9 with the ammunition clip inserted.

Referring now also to FIG. 9, the action (operating rod 62 and bolt 68) is shown in the fully retracted, open position. The ammunition clip assembly 34 may be inserted vertically into position and held in place by the axis rod 70, which engages the center opening 46 of the main body 36. The axis rod 70 may be spring biased toward a rear, engaged position and locked in a forward, open position by rotation of the thumb latch 72 in the thumb latch slot 74 of the grip rail 18. As shown in FIG. 10, when the clip assembly 34 is inserted in place, a forward tooth 76 of the rotation index lever or ratchet lever 78 will engage the ratchet pawls or teeth 48.

Figure 11:
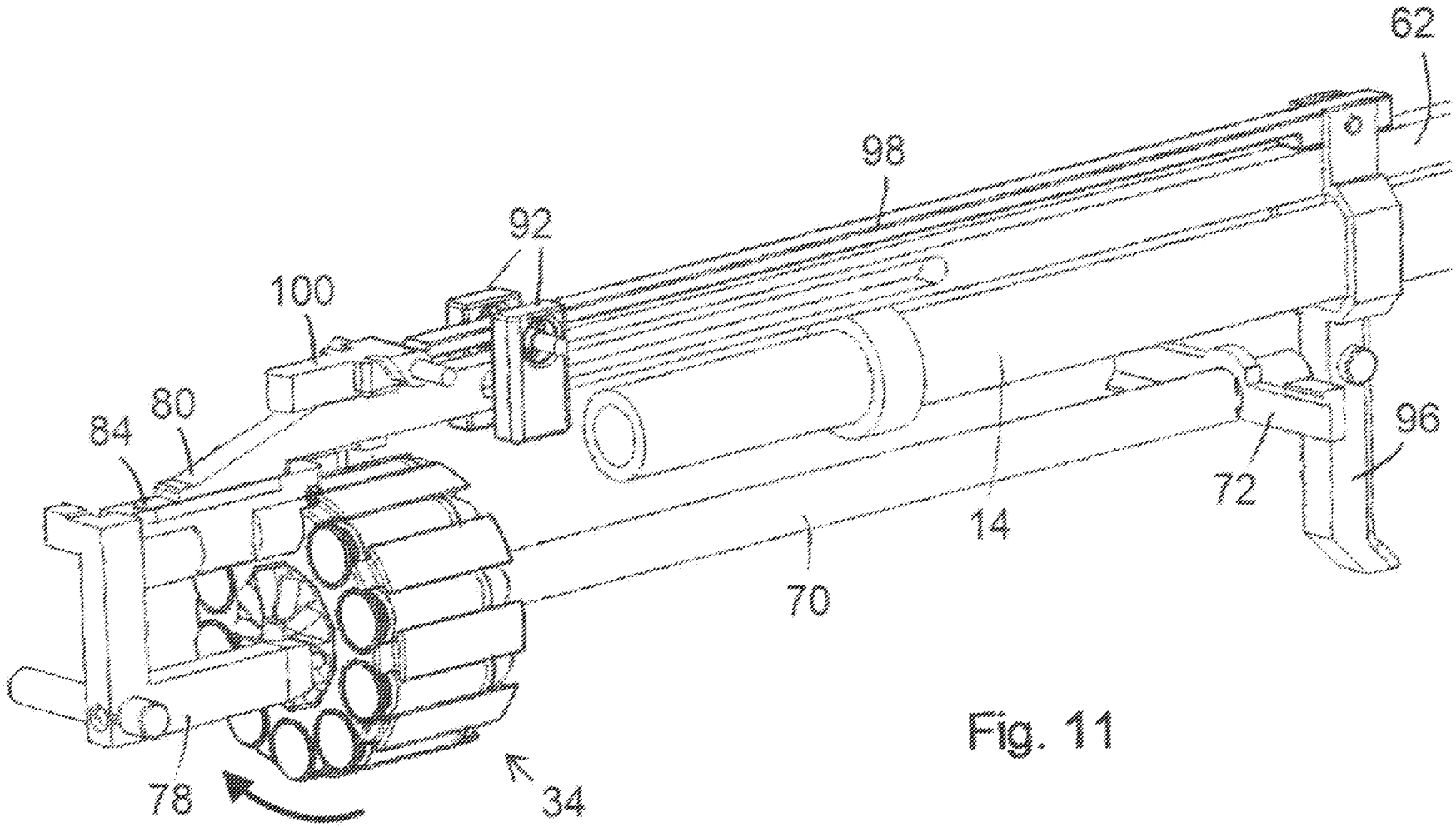
FIG. 11 is a similar view showing the rotary ammunition clip inserted and with the action mechanism components moved slightly forward so that the clip rotation lever has engaged the radial ratchet teeth or pawls on the rear face and advanced the ammunition clip body.

Referring now to FIG. 11, as the operating rod 62 is partially moved forward by manual movement of the pump grip 52, the rear end 80 of the operating rod 62 disengages from the upper arm of the rotation index lever or ratchet lever 78, which is spring biased (not shown) toward the forward position. This causes the lower arm of the rotation index lever or ratchet lever 78 to swing downwardly, and the engagement between the forward tooth 76 and ratchet pawls or teeth 48 cause the clip assembly 34 to advance one position. In the illustrated example, the clip assembly 34 includes ten longitudinal cartridge sockets 38, allowing it to hold ten ammunition cartridges 40. Accordingly, the clip assembly 34 is moved one-tenth of a full rotation, or 36 degrees.

The operating rod 62 engages the bolt 68 with a lost motion connection. Specifically, the operating rod 62 includes an engagement tooth 82 that is received in a longitudinally oriented engagement slot 84 provided in the top surface of the bolt 68. Accordingly, the operating rod 62 may be partially advanced forward, releasing the rotation index lever or ratchet lever 78 so that it may advance the clip assembly 34 one position. Further forward movement of the operating rod 62 causes the engagement tooth 82 to meet the forward end of the engagement slot 84 and begin forward advancement of the bolt 68.

Figure 12:
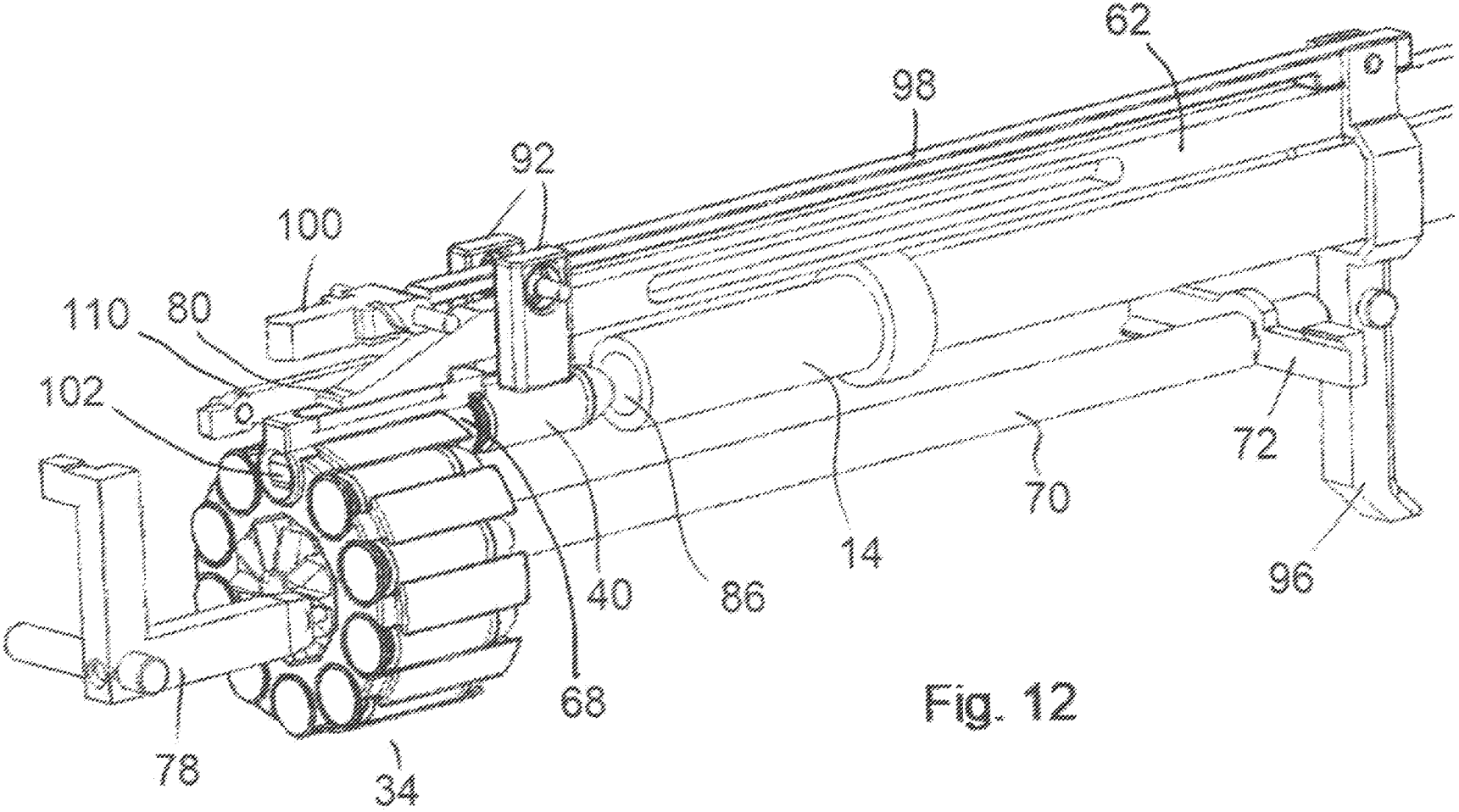
FIG. 12 is a similar view showing the action with the bolt partially advanced forward to push an ammunition cartridge out of its socket in the rotary clip and toward the chamber.

Referring now to FIG. 12, further forward advancement of the operating rod 62 by manual movement of the pump grip 52 (not shown in FIG. 12) allows a lower portion of the bolt 68 to enter a cartridge socket 38 of the clip assembly 34, advancing a cartridge 40 forwardly out of the socket 38 and toward a chamber 86 at the rear end of the barrel 14. Unlike in most firearm designs, the bolt 68 is substantially the same diameter as the cartridge 40, which allows the bolt 68 to pass through the socket 38. As the operating rod 62 is further advanced, the bolt 68 moves the cartridge 40 into the chamber 86. Because the socket 38 from which the cartridge 40 is delivered is substantially axially aligned with the chamber 86, there is no angular movement of the cartridge 40 and no need for a feed ramp, which can affect the chamber strength in other designs.

Figure 13:
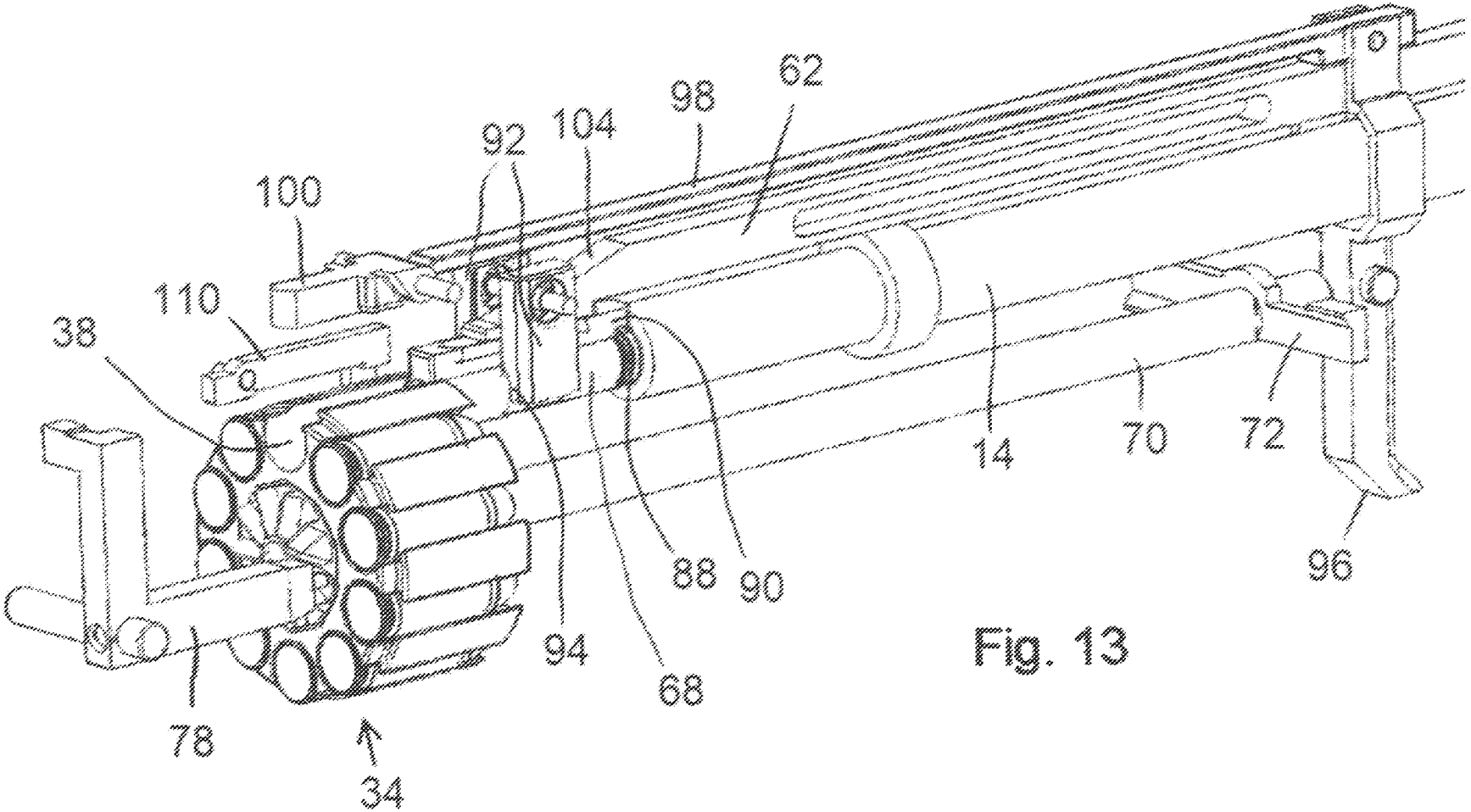
FIG. 13 is a similar view showing the action fully advanced forward to an in-battery position in which the ammunition cartridge is chambered and lock members are lowered into engagement with the bolt.
Figure 14:
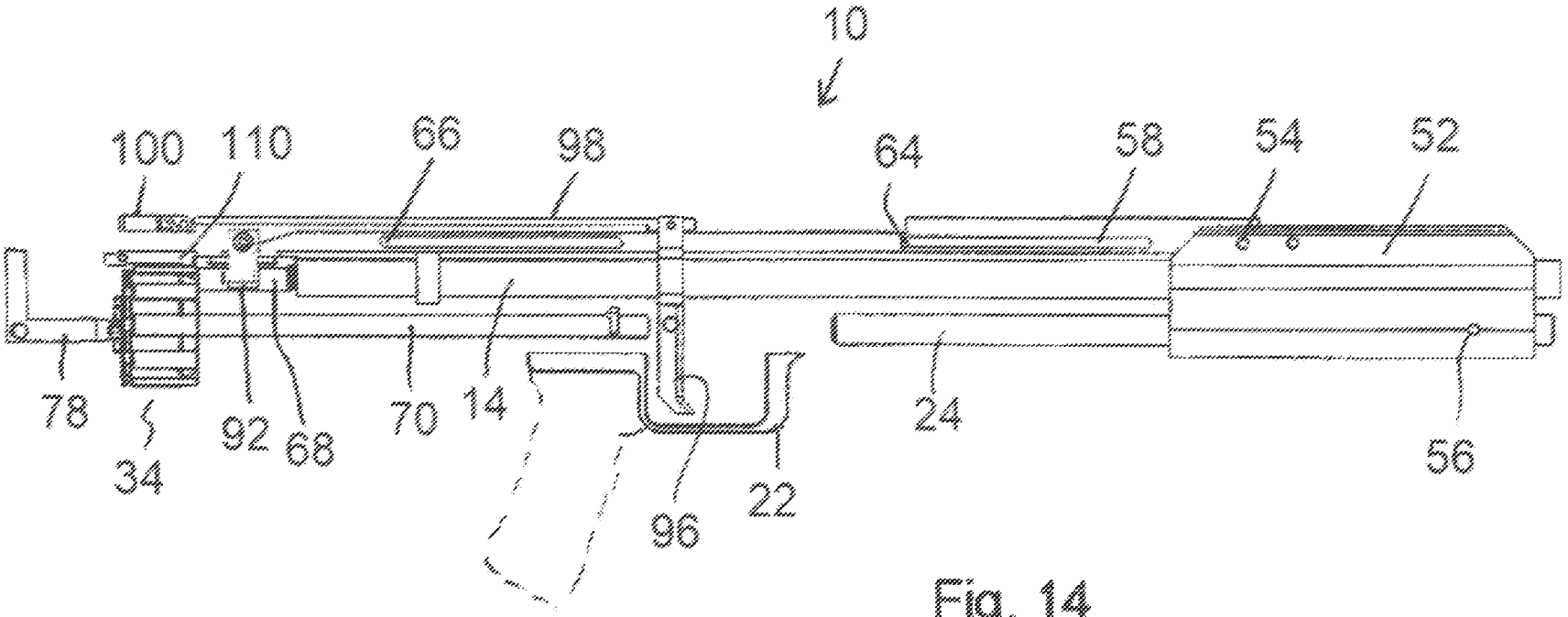
FIG. 14 is a side elevation view similar to what is shown in FIG. 13 with the action fully in-battery and locked.

When fully in-battery (FIGS. 13 and 14), a rim portion 88 of the cartridge 40 does not have to be fully supported. The rim portion 88 remains engaged with the extractor 90, which can be a non-moving portion of the bolt 68. The face of the bolt 68 is substantially the same diameter as the base of the cartridge 40. The extractor 90 does not need to deflect, as it does in most bolt designs, because it engages the rim portion 88 of a cartridge 40 as the clip assembly 34 is upwardly inserted into position. The rim 88 of each cartridge is engaged and disengaged from the extractor 90 as the clip assembly 34 rotates between indexed positions. The annular groove 50 allows the extractor 90 to disengage one cartridge 40 as the main body 36 is rotated to its next indexed position, there the extractor 90 slides into engagement with the rim 88 of another cartridge 40.

When the bolt 68 has reached its forward end of travel, locking blocks 92 are spring biased downwardly to engage locking grooves 94 on opposite sides of the bolt 68. This engagement between the locking blocks 92 and locking grooves 94 hold the bolt 68 in-battery for firing.

Figure 14A:
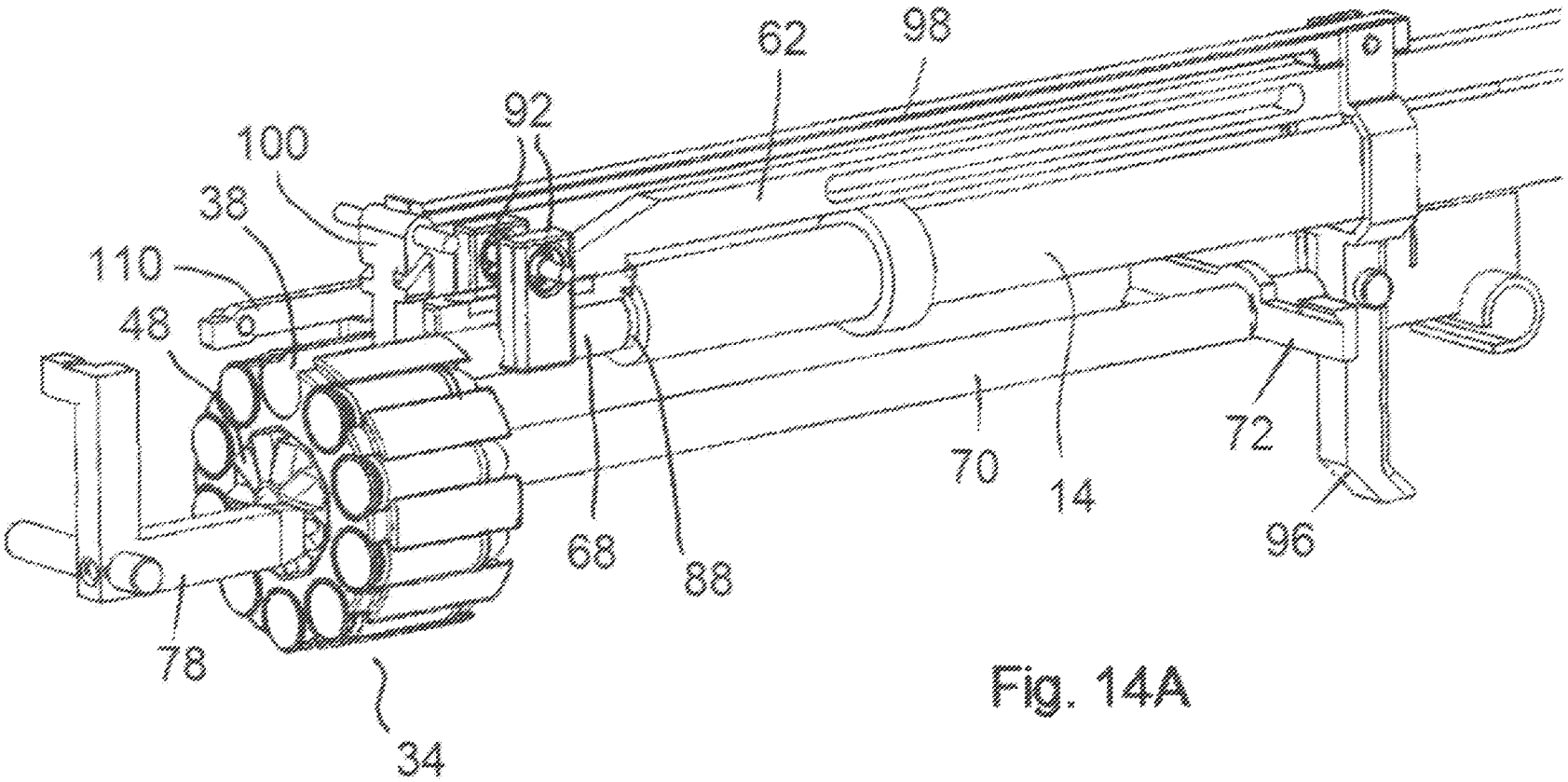
FIG. 14A is an isometric partial view similar to that shown in FIGS. 9-13, in which the trigger has been pulled, to disengage the sear from the hammer and allow the hammer to drop, striking the firing pin, which fires the cartridge, propelling the now displaced projectile through the barrel.

Referring now to FIG. 14A, a trigger 96 is pivotally carried by the grip rail 18 (not shown in FIG. 14A). The upper end of the trigger 96 is pivotally connected to an elongated sear 98. A rearward pull on the lower end of the trigger 96 causes corresponding forward movement of the upper end and of the sear 98. This forward movement causes the sear 98 to disengage the spring biased hammer 100, allowing the hammer 100 to pivotally drop against the firing pin 102 carried by the bolt 68. In the well-known manner, the hammer 100 striking the firing pin 102 causes the cartridge 40 to discharge, propelling a projectile through the bore of the barrel 14.

Figure 15:
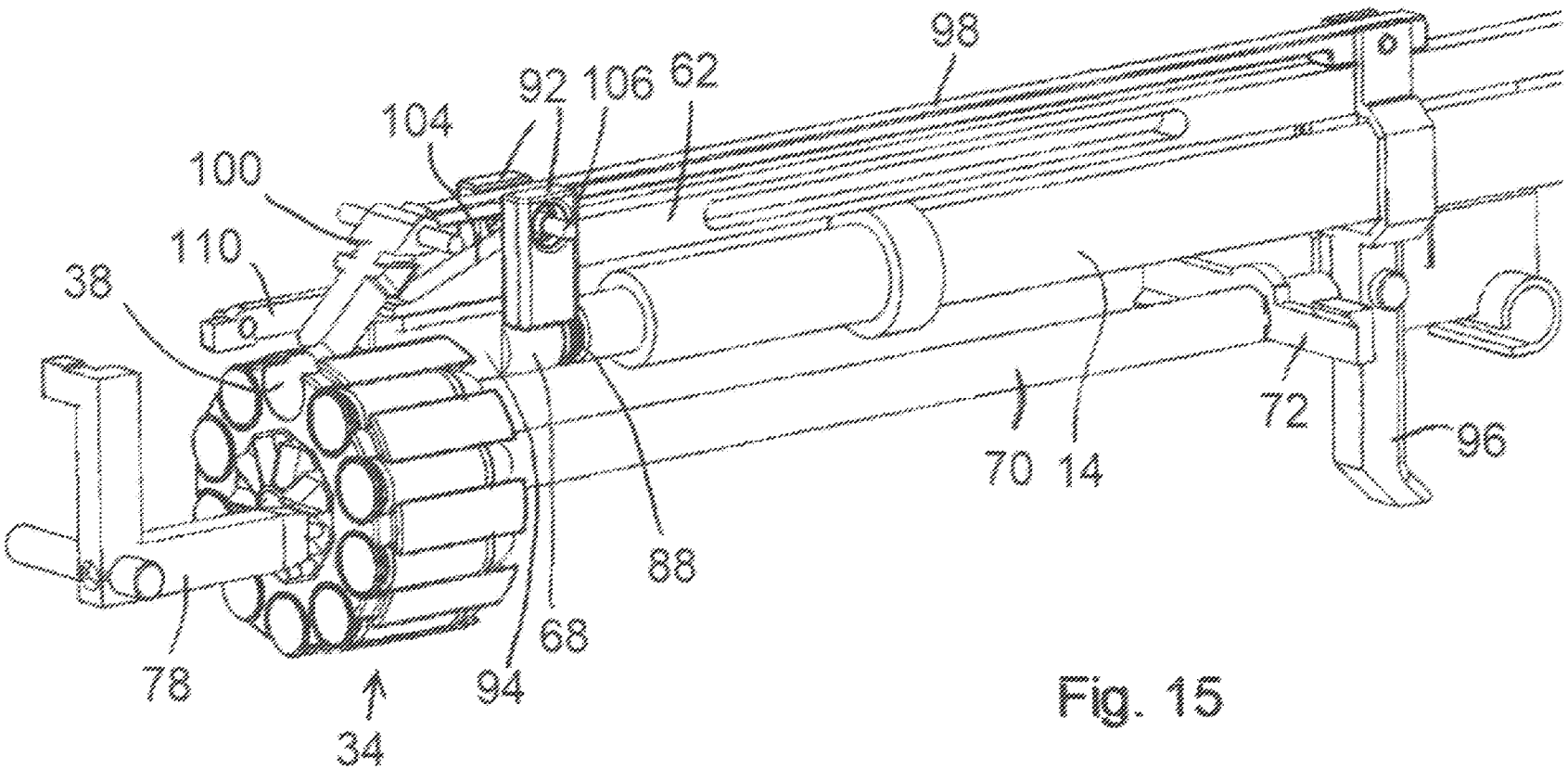
FIG. 15 is a similar view showing the action partially retracted, which lifts the locking block members and begins reset of the hammer.

After firing, the rifle 10 may be manually re-cocked by cycling the action with the pump grip 52. Referring now to FIG. 15, as the pump grip 52 is pulled rearwardly to manually cycle the action, the operating rod 62 is moved to the rear, as well. This rearward movement begins to lift the hammer 100 back toward its set position. At the same time, a lift ramp 104 on the upper surface near the rear end 80 of the operating rod 62 engages a cross pin 106 engaged with the locking blocks 92, lifting the locking blocks 92 out of engagement with the locking grooves 94 of the bolt 68. The cross pin 106 may be guided by vertical slots 108 in the receiver 12. The previously described lost motion connection between the operating rod 62 and the bolt 68 allows this initial rearward movement of the operating rod to lift the locking blocks 92 prior to causing any rearward movement of the bolt 68.

Continued rearward movement of the pump grip 52 causes the operating rod 63 and bolt 68 to retract toward the rear. The bolt 68 passes through the cartridge slot 38 of the clip assembly 34 (as previously described with respect to FIG. 11), pulling the spent casing 42 with it. Continued retraction of the pump grip 52, operating rod 62, and bolt 68 will fully reset the hammer 100 into engagement with the sear 98 (as generally shown in FIG. 9A) and return the spent casing 42 to its socket 38 in the clip assembly. The final rearward travel of the operating rod 62 engages and displaces the rotation index lever or ratchet lever 78 (as shown in FIG. 9A). This rearward rotation of the upper arm of the index lever or ratchet lever 78 causes the forward tooth 76 to slide over the ratchet pawl or tooth to reset. In this position, the ammunition clip assembly 34 could be removed (by releasing the axis rod 70), or the action may be cycled forwardly, causing the main body 36 of the ammunition clip assembly 34 to rotate one position and move a fresh cartridge 40 into the chamber 86, as previously described.

Figure 16:
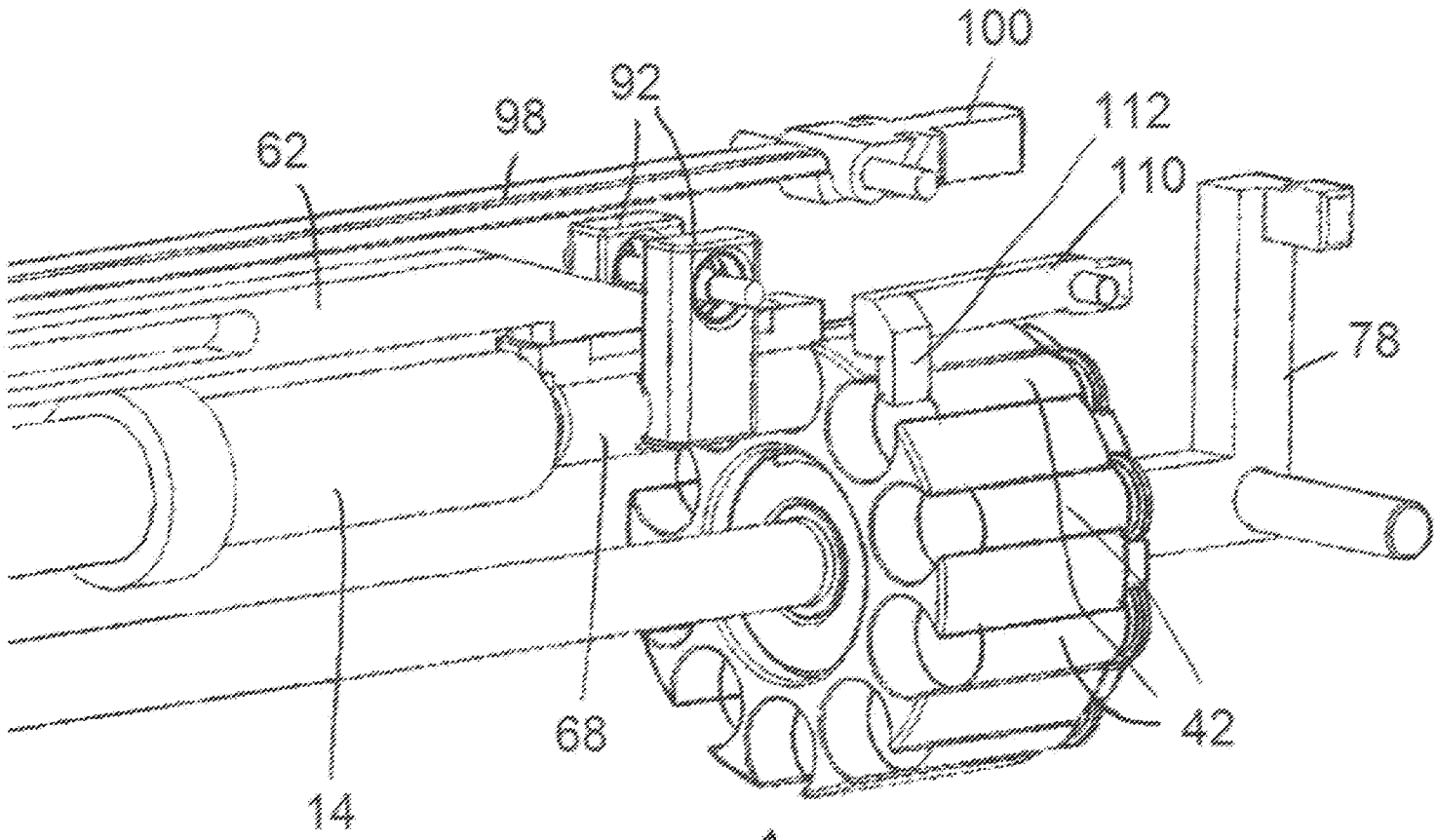
FIG. 16 is a reverse (left) side isometric view showing the anti-rotation lever which has sensed the absence of a projectile in the next ammunition socket and has blocked further rotation of the clip body.

Referring now to FIG. 16, once the final cartridge 40 has been chambered and fired, an anti-rotation lever 110 may be used to prevent further rotation of the clip assembly 34. The spring biased anti-rotation lever 110 may be pivotally mounted to the frame 12 (not shown in FIG. 16) and include a sensing finger 112 at its forward end. The sensing finger 112 is positioned to contact a projectile 44 when a loaded cartridge 40 is in the cartridge socket 38 next in line for advancement to a position in line with the bolt 68. When the next in line cartridge 40 has already been fired, the absence of a projectile 44 allows the sensing finger 112 to partially drop into the cartridge slot 38, blocking further rotation of the clip assembly 34. This signals to the user that the ammunition clip 34 is empty and needs to be replaced.

As previously described, the "empty" clip assembly 34 retains the spent casings 42 and are removed by the user together (i.e., en bloc). This may then be replaced with another clip assembly 34 carrying loaded ammunition cartridges 40. The spent casings 42 may be manually removed from the clip assembly 34 and replaced with fresh ammunition after the clip assembly 34 has been detached from the rifle 10. Unlike the cylinder of a revolver, where the ammunition is fired while in each of the chambers, the ammunition cartridges 40 in this embodiment are individually moved from the socket 38 to the barrel chamber 86 for firing. Thus, the clip assembly 34 can be made from lightweight, low cost material, such as aluminum, die cast metals, injection molded plastic, etc. The clip assembly 34 may even be considered disposable and not reloaded after the cartridges 40 have been fired.

Figure 17:
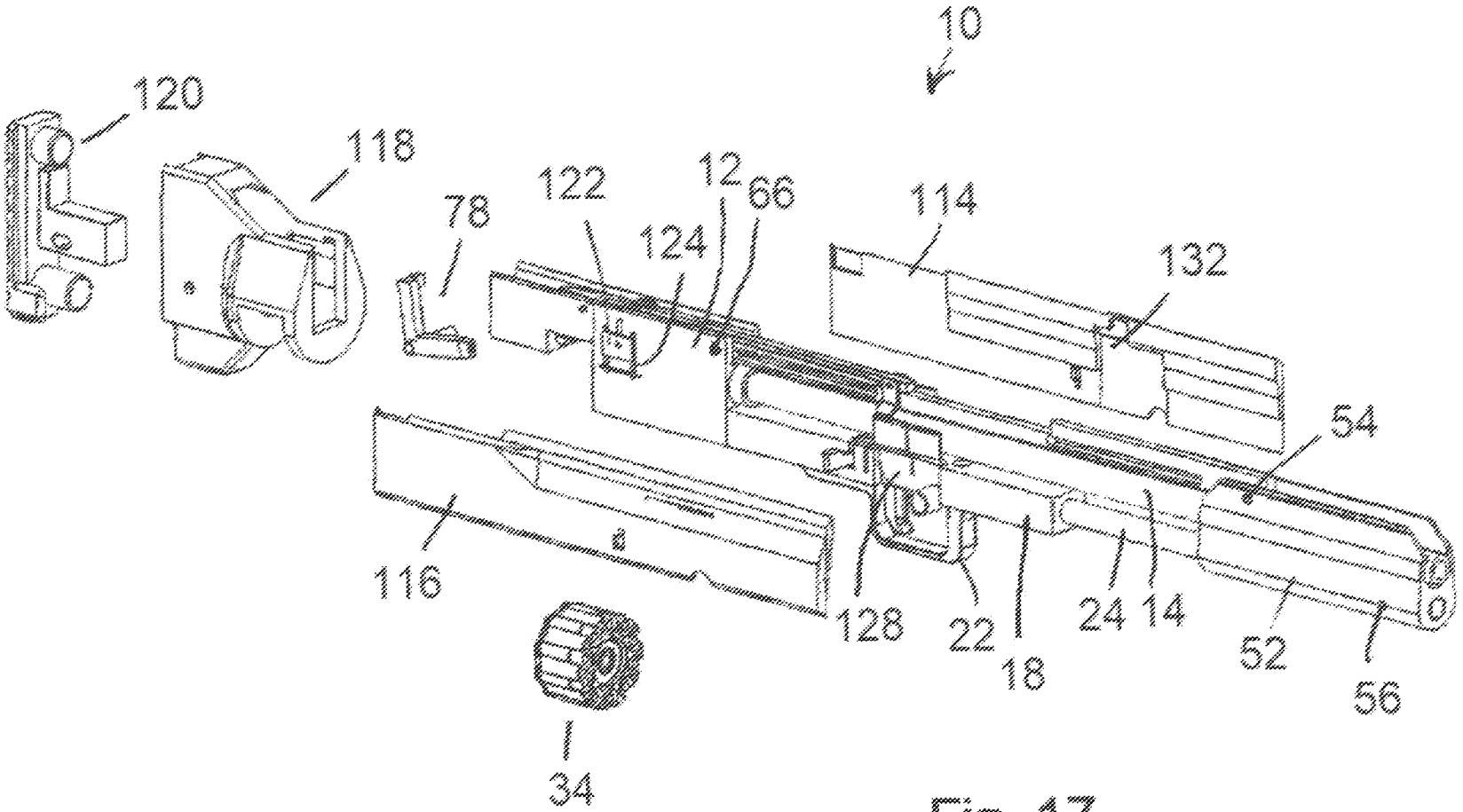
FIG. 17 is a partially exploded isometric view of the carbine rifle.

Referring now to FIG. 17, the rifle 10 is shown partially exploded to illustrate the removeable left and right side panels 114, 116, stock housing 118, and butt plate 120. The side panels 114, 116 may not be essential to operation of the rifle 10, but provide some protective function in addition to providing a smooth exterior appearance. The stock housing 118 receives and helps to support the ammunition clip assembly 34. It also supports the rotation index lever or ratchet lever 78. A butt plate 120 may be attached to the stock housing 118 and may be made of a cushioning material and/or spring mounted to absorb recoil.

Figure 18:
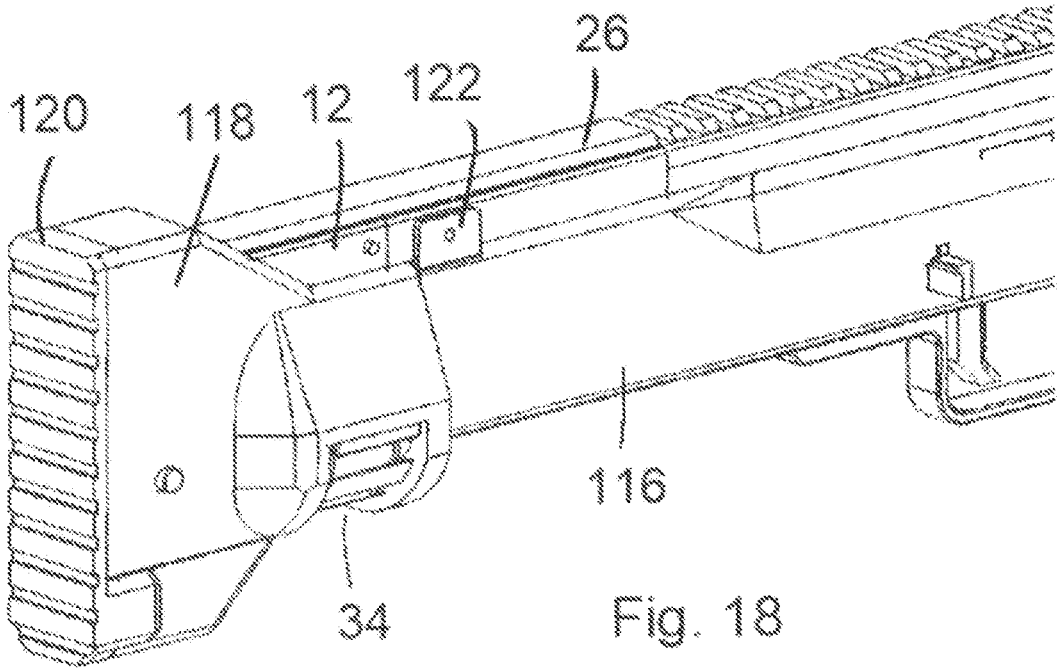
FIG. 18 is a partial isometric view showing a chamber indicator in an UNLOADED position.
Figure 19:
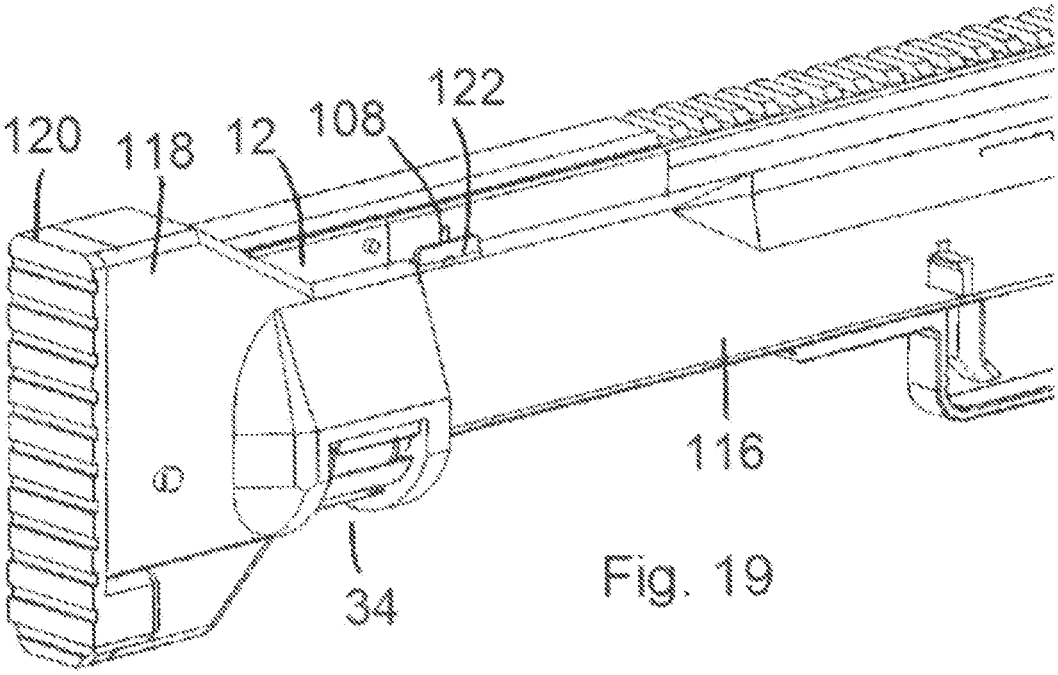
FIG. 19 is a similar view showing the chamber indicator in an LOADED position.

Safety features of the invention can include a loaded chamber indicator. This indication is provided by locking blocks extensions 122 that are exposed to the exterior of the rifle 10. When the locking blocks 92 are lifted, the extensions are exposed (as shown in FIG. 18) to provide a visual and tactile indication that the bolt 68 is retracted to an open position and there is no cartridge 40 in the chamber 86. When the bolt 68 is closed, the locking blocks 92 fall to lock the bolt 68 in battery and the locking block extensions 122 also retract behind the side panels 114, 116 (as shown in FIG. 19). Guides 124, 126 in the receiver 12 and/or the side panels 114, 116 can be provided to align the extensions 122 as they extend and retract.

Figure 20:
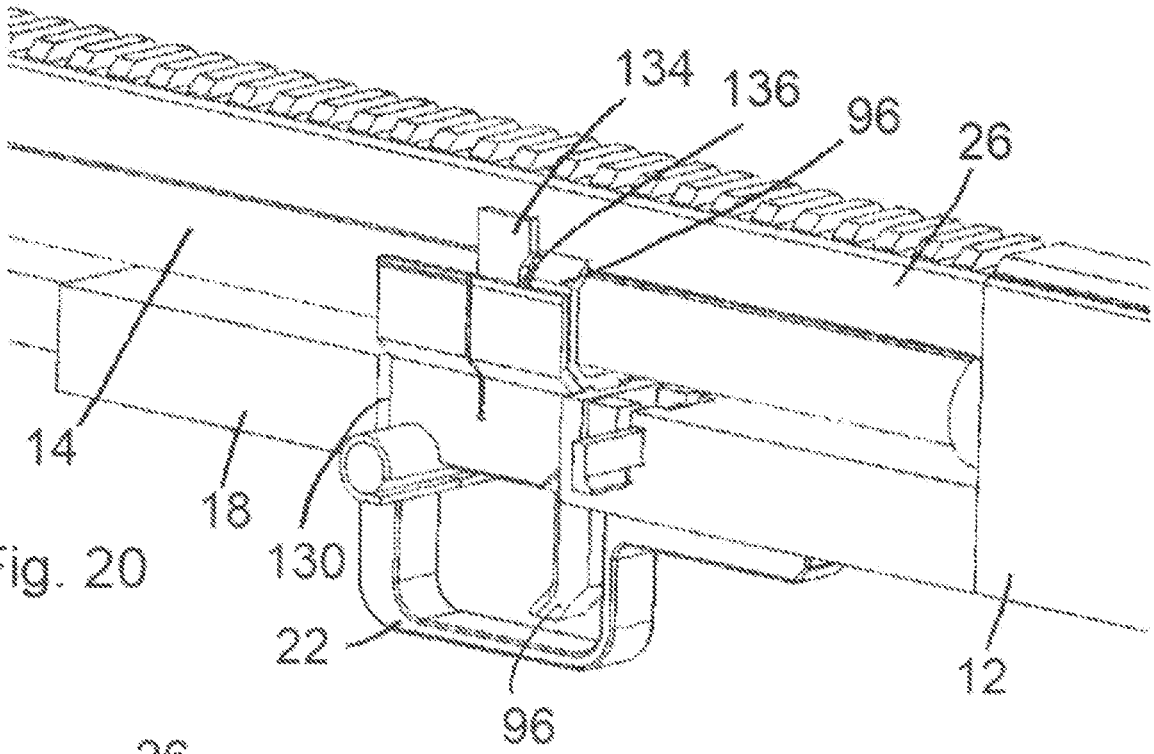
FIG. 20 is a left side partial isometric view with cover plate removed showing a trigger safety member in the FIRE position.
Figure 21:
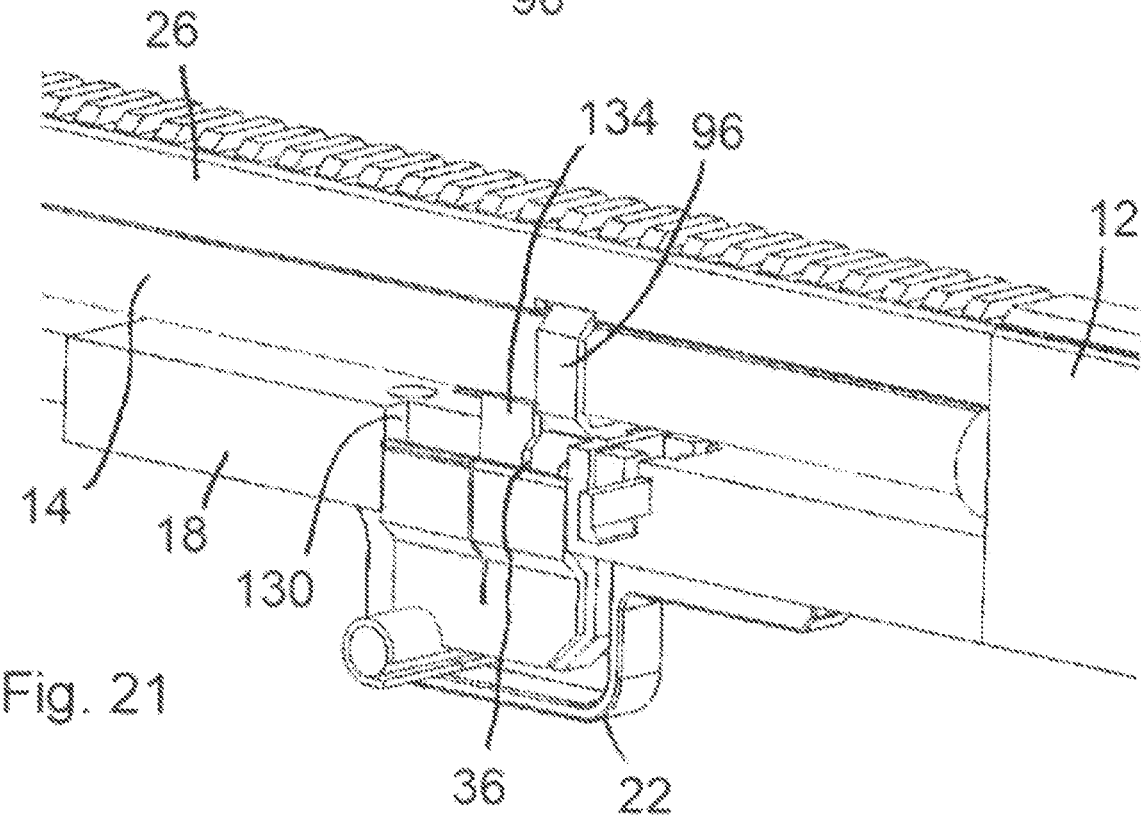
FIG. 21 is a similar view showing the trigger safety member in the SAFE position.

Another safety feature can include a retractable trigger cover 128 that is vertically movable between raised (FIG. 20) and lowered (FIG. 21) positions. The trigger cover 128 is carried on the grip rail 18 and may be guided in slots 130, 132 in the grip rail 18 and/or side panels 114, 116. When lowered, as shown in FIG. 21, sides of the cover 128 provide a curtain that physically blocks access to the trigger 96, filling the trigger guard 22. The cover can also include a blocking finger 134 that is aligned to block forward pivotal movement of the upper portion of the trigger 96. Conversely, the blocking finger 134 may include a notch 136 or other accommodation to allow pivotal movement of the trigger 96 when the cover 128 is raised.

The resulting firearm of this invention is one that is inherently fully ambidextrous, requiring no change-over from left- to right-handed shooting. The design can easily be adapted for use with a muzzle-attached noise suppressor or integral suppression. There are no concerns of reliability due to varied back pressure and no loss of energy due to auto-cycling the action or gaps in the system (as are found in a revolver having multiple chambers in a cylinder that must mate to a separate barrel. As with other pump-action systems, the action is completely mechanical and does not rely on gas flow/pressure or timing to unlock and cycle the system. All of the propellant energy of the cartridge 40 is used to propel the projectile, so velocity and internal ballistics are maximized.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A pump-action firearm, comprising:

a frame;

a barrel having a chamber and supported on the frame;

a rotating ammunition clip with a plurality of circumferentially spaced cartridge sockets, the clip removably supported by the frame;

a bolt manually slidably cycled between in-battery and retracted positions, the bolt moveable into a socket to push a cartridge out of the socket and into the chamber to the in-battery position and retractable to extract the cartridge from the chamber and back into the socket.

2. The firearm of claim 1, further comprising a mechanism for rotatably advancing the clip to align an adjacent socket with the chamber each time the bolt is manually cycled.

3. The firearm of claim 2, wherein the clip includes a series of ratchet pawls and the mechanism includes a rachet lever configured to interact with the pawls.

4. The firearms of claim 1, further comprising at least one block member vertically movable between a locked position in which the block member engages the bolt when in the in-battery position and an unlocked position in which the block member is disengaged from the bolt.

5. The firearm of claim 4, wherein a cam operably connected to the bolt moves the block member when the bolt is cycled.

* * * * *